US008225853B2

(12) United States Patent
Macri et al.

(10) Patent No.: US 8,225,853 B2
(45) Date of Patent: Jul. 24, 2012

(54) MULTI-PASS HEAT EXCHANGERS HAVING RETURN MANIFOLDS WITH DISTRIBUTING INSERTS

(75) Inventors: Salvatore Macri, Milan (IT); Mikhail B. Gorbounov, South Windsor, CT (US); Yirong Jiang, Manchester, CT (US); Jules Ricardo Munoz, South Windsor, CT (US); Young K. Park, Simsbury, CT (US); Parmesh Verma, Manchester, CT (US); Henry Beamer, Middleport, NY (US); Robert Runk, Lockport, NY (US)

(73) Assignees: Carrier Corporation, Farmington, CT (US); Delphi Technologies, Inc., Troy, MI (US)

( * ) Notice: Subject to any disclaimer, the term of this patent is extended or adjusted under 35 U.S.C. 154(b) by 349 days.

(21) Appl. No.: 12/445,444

(22) PCT Filed: Oct. 12, 2007

(86) PCT No.: PCT/US2007/021859

§ 371 (c)(1),
(2), (4) Date: Apr. 13, 2009

(87) PCT Pub. No.: WO2008/048505

PCT Pub. Date: Apr. 24, 2008

(65) Prior Publication Data

US 2010/0089095 A1 Apr. 15, 2010

(51) Int. Cl.
*F28F 9/22* (2006.01)

(52) U.S. Cl. ..... 165/174

(58) Field of Classification Search ..... 165/174; 62/525

See application file for complete search history.

(56) References Cited

U.S. PATENT DOCUMENTS

| | | | | |
|---|---|---|---|---|
| 5,582,239 | A | 12/1996 | Tsunoda et al. | |
| 5,806,586 | A * | 9/1998 | Osthues et al. | 165/174 |
| 5,934,367 | A * | 8/1999 | Shimmura et al. | 165/174 |
| 6,125,927 | A | 10/2000 | Hubert | |
| 6,729,386 | B1 * | 5/2004 | Sather | 165/110 |
| 7,036,571 | B2 * | 5/2006 | Kamiyama et al. | 165/174 |
| 7,331,195 | B2 * | 2/2008 | Bae et al. | 62/504 |
| 7,806,171 | B2 * | 10/2010 | Taras et al. | 165/174 |
| 2001/0035025 | A1 | 11/2001 | Watanabe et al. | |
| 2005/0132744 | A1 | 6/2005 | Rohrer et al. | |
| 2005/0235691 | A1 | 10/2005 | Katoh et al. | |

(Continued)

FOREIGN PATENT DOCUMENTS

DE 10322165 A1 12/2004

(Continued)

OTHER PUBLICATIONS

Official Search Report and Written Opinion of the International Searching Authority in counterpart foreign Application No. PCT/US07/21859 filed Oct. 12, 2007.

(Continued)

*Primary Examiner* — Allen Flanigan
(74) *Attorney, Agent, or Firm* — Cantor Colburn LLP

(57) ABSTRACT

A multi-pass heat exchanger having a return manifold with a partition, a front wall, and a rear wall is provided. The partition separates the return manifold into a collection chamber and a distribution chamber. The front and rear walls define a fluid channel. The front wall has a plurality of perforations placing the fluid channel in separate fluid communication with the collection chamber and the distribution chamber.

11 Claims, 2 Drawing Sheets

U.S. PATENT DOCUMENTS

| | | | | |
|---|---|---|---|---|
| 2006/0054310 | A1 | 3/2006 | Kim et al. | |
| 2006/0137870 | A1 | 6/2006 | Ohhashi et al. | |
| 2006/0162918 | A1 | 7/2006 | Horiuchi et al. | |
| 2008/0023184 | A1* | 1/2008 | Beamer et al. | 165/174 |
| 2008/0023185 | A1* | 1/2008 | Beamer et al. | 165/174 |

FOREIGN PATENT DOCUMENTS

| | | | |
|---|---|---|---|
| EP | 0887611 | A2 | 12/1998 |
| JP | 10206081 | A | 8/1998 |
| WO | WO2006006743 | A1 | 1/2006 |
| WO | WO 2006078048 | A1 * | 7/2006 |
| WO | WO2006083448 | A1 | 8/2006 |

OTHER PUBLICATIONS

European Search Report for International Application No. PCT/US2007021859, Feb. 4, 2011, 10 pages.

* cited by examiner

MULTI-PASS HEAT EXCHANGERS HAVING RETURN MANIFOLDS WITH DISTRIBUTING INSERTS

BACKGROUND OF THE INVENTION

1. Field of the Invention

The present disclosure relates to multi-pass heat exchangers. More particularly, the present disclosure relates to a multi-pass heat exchanger having a distributing insert in the return manifold.

2. Description of Prior Art

Refrigeration systems are well known in the art and ubiquitous in such industries as food service, chemical, residential and commercial cooling, and automotive. On a larger scale, heat exchangers are required for office buildings and for residential purposes. Lack of efficiency is a great concern with such systems.

Traditional refrigeration cycles, or air conditioners, include a compressor, a condenser, an expansion valve, an evaporator, and a refrigerant whose evaporation creates the cool temperature. In some refrigeration systems, the evaporator is a series of parallel narrow tubes, which provide parallel refrigerant paths. When the refrigerant passes through the expansion valve, a pressure and temperature drop occurs.

In many refrigerant vapor compression systems, as the refrigerant passes through the expansion valve, a portion of the fluid expands to vapor. The resulting two-phase mixture can cause maldistribution in the evaporator, which is a common problem with heat exchangers that use parallel refrigerant paths, resulting in poor heat exchanger efficiency. For heat exchangers that have relatively few parallel refrigerant paths (typically 20 or less), even distribution of the two-phase fluid is achieved through a distribution device that individually feeds each parallel refrigerant path. However, for heat exchanges with many parallel refrigerant paths (typically more than 20), individual distribution to each parallel refrigerant path is often not practical. In most cases, a simple inlet header is used, which can lead to significant refrigerant maldistribution to the heat exchanger. Additionally, gravity and the increase in overall volume as the flow transitions from the expansion device to the inlet header also act to cause the liquid and vapor to separate.

Previously, it has been proposed by U.S. Pat. No. 7,143,605 to include a distributor tube positioned within the inlet manifold to reduce maldistribution. While the distributor tube within the inlet manifold has proven to be helpful to reduce maldistribution, the maldistribution of the liquid-phase and vapor-phase within the heat exchanger remains problematic.

Therefore, there exists a need for heat exchanger that overcome, alleviate, and/or mitigate one or more of the aforementioned and other deleterious effects of prior art heat exchangers.

SUMMARY OF THE INVENTION

A multi-pass heat exchanger having a return manifold with a partition, a front wall, and a rear wall is provided. The partition separates the return manifold into a collection chamber and a distribution chamber. The front and rear walls define a fluid channel. The front wall has a plurality of perforations placing the fluid channel in separate fluid communication with the collection chamber and the distribution chamber.

A multi-pass heat exchanger having an inlet manifold, a return manifold, a plurality of channels, and a distributing insert is provided. The inlet manifold has a first partition defining an inlet chamber and an outlet chamber. The return manifold has a second partition defining a collection chamber and a distributing chamber. The plurality of channels define a first fluid flow path between the inlet chamber and the collection chamber and a second fluid flow path between the distributing chamber and the outlet chamber. The distributing insert is within the return manifold. The distributing insert has a first plurality of perforations in fluid communication with the collecting chamber and a second plurality of perforations in fluid communication with the distributing chamber.

The above-described and other features and advantages of the present disclosure will be appreciated and understood by those skilled in the art from the following detailed description, drawings, and appended claims.

BRIEF DESCRIPTION OF THE DRAWINGS

These and other objects of the present disclosure will be more apparent from the following detailed description of the present disclosure, in conjunction with the accompanying drawings wherein.

DETAILED DESCRIPTION OF THE INVENTION

Figure 1:
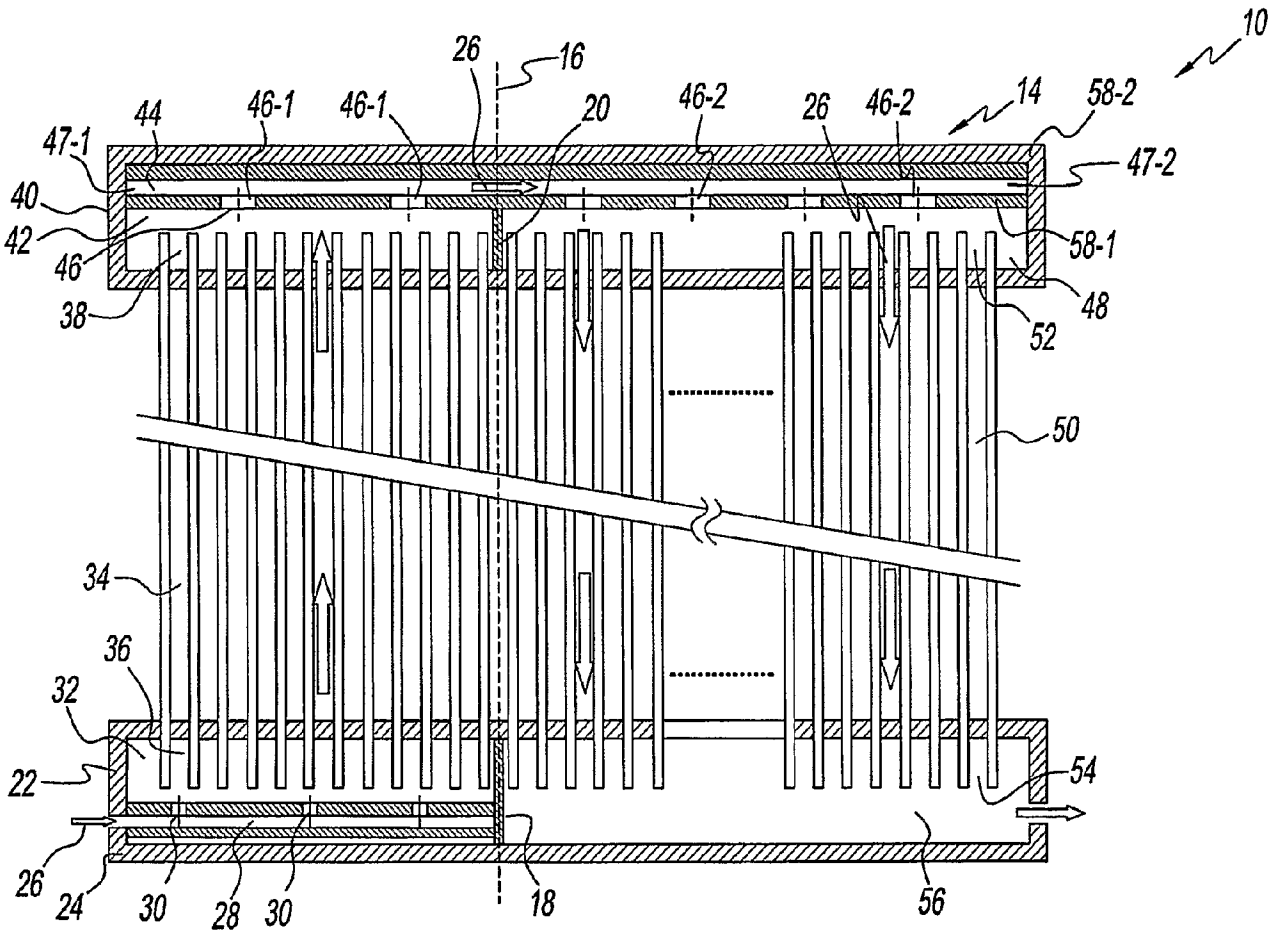
FIG. 1 is a sectional view of an exemplary embodiment of heat exchanger with a distributing insert tube according to the present disclosure.
Figure 2:
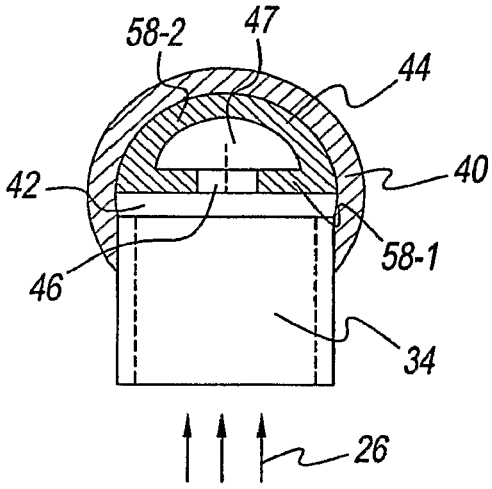
FIG. 2 is a sectional view of the heat exchanger of the present disclosure, taken along lines 2-2 of FIG. 1.

Referring now to the figures and in particular to FIGS. 1 and 2, an exemplary embodiment of a heat exchanger according to the present disclosure is shown and is generally referred to by reference numeral 10. Heat exchanger 10 is a parallel path heat exchanger and, advantageously, includes an insert 44 that collects, mixes, and distributes fluid within a return manifold of the heat exchanger.

In the illustrated embodiment, heat exchanger 10 is a micro-channel heat exchanger. However, it is contemplated by the present disclosure for insert 44 to find equal use with any type of parallel path heat exchanger.

FIG. 1 illustrates heat exchanger 10 divided into two passes, namely a first pass 12 and a second pass 14. First pass 12 and second pass 14 are defined by a transition line 16 defined by partitions 18 and 20.

Partition 18, which separates first pass 12 from second pass 14 in an inlet manifold 22, extends the width of the entire inlet manifold 22. The other ends of manifold 22 are sealed by endcaps 24 having ports (not shown) defined therein. Partition 18 prevents a fluid 26, such as a refrigerant, from by passing first and second passes 12, 14 through inlet manifold 22.

Partition 20, which separates first pass 12 from second pass 14 in a return manifold 40, extends the width of the entire return manifold 40. Partition 20 prevents fluid 26, such as a refrigerant, from passing to second pass 14 through return manifold 40 unless it first passes through distributing insert 44.

Fluid 26 can be either a single or a two-phase refrigerant. Thus, fluid 26 traveling through heat exchanger 10 can be in either a vapor-phase or a liquid-phase when traversing through the exchanger. Fluid 26 is represented by an arrow, which indicates the direction of flow through heat exchanger 10.

Inlet manifold 22 receives fluid 26 flowing through an internal distributor 28. Internal distributor 28 has a series of small orifices 30 that distribute fluid into an inlet chamber 32 of inlet manifold 22. Several micro-channel tubes (tubes) 34, which have an inlet end 36 and an outlet end 38, define a fluid flow path extending from inlet manifold 22 to a return manifold 40. Inlet end 36 is in fluid flow communication with inlet chamber 32 of inlet manifold 22. Return end 38 is in fluid flow communication with a collection chamber 42 of return manifold 40.

First pass 12 is defined as the fluid path from inlet manifold 22 to collection chamber 42 of return manifold 40 through parallel tubes 34. Second pass 14 is defined as the fluid path from a distributing chamber 48 of return manifold 40 to outlet chamber 56 of inlet manifold 22 through parallel tubes 50.

Fluid 26 is ideally evenly distributed within tubes 34 in first pass 12. Each tube 34 is a very narrow tube, and heat exchanger 10 has several such tubes that comprise the main body of the heat exchanger that transport fluid 26 during evaporation. Tubes 34 are aligned parallel to one another, and while FIG. 1 shows a two-pass configuration of a heat exchanger, a multi-pass heat exchanger having more than two passes could also be used. In a multi-pass heat exchanger having more than two passes, a second return manifold replaces outlet chamber 56, and this second return manifold directs fluid to either an outlet manifold, or another return manifold for another pass. The number of return manifolds required is dependent on the number of passes.

While FIG. 1 shows insert 44 disposed in return manifold 40, an insert 44 could also be located in outlet chamber 56 of inlet manifold 22 opposite partition 18, particularly if outlet chamber 56 in inlet manifold 22 is to function as a return manifold for a third pass (not shown).

Fluid 26 is transported through tubes 34 to collection chamber 42. Collection chamber 42 collects fluid from first pass 12 of tubes 34 and passes the fluid to insert 44. Insert 44 mixes and transports fluid 26 from first pass 12 to second pass 14. Ideally, fluid 26 is a homogeneous mix of evaporated in a vapor-phase and a liquid-phase. Collecting and mixing fluid 26 in insert 44, enables homogenous mixing of the fluid before progressing to second pass 14. Insert 44 has a series of collecting and distributing perforations 46 disposed along insert 44 that direct fluid 26 into and out of distributing insert 44.

Perforations 46-1 are positioned in insert 44 in first pass 12. Perforations 46-1 receive fluid 26 from collection chamber 42. Fluid 26 entering insert 44 at perforations 46-1 exits insert 44 at perforations 46-2 on the second pass 14. Fluid 26 exiting through perforations 46-2 in insert 44 enter distributing chamber 48 where fluid 26 then enters second pass 14.

Perforations 46 are preferably of variable size to effectively mix and distribute fluid 26 within insert 44 and distributing chamber 48. Perforations 46 can have an opening dimension that can be uniform across insert 44, or the opening dimension of the perforations can increase in size from first pass 12 to second pass 14. For example, perforations 46 can increase in dimension further downstream of the fluid flow path can achieve a greater degree of fluid distribution. The increase in size of perforations 46 can be incremental or one can use another pattern to decide the perforation size.

The size and positioning of perforations 46 can influence the degree that the pressure in the heat exchanger 10 is impacted. Thus, the total cross-section of all perforations 46 in insert 44 impacts the degree that pressure is effected in heat exchanger 10. In an exemplary embodiment of the disclosed insert 44, the perforations 46 are configured so that insert 44 does not cause a drop in pressure in heat exchanger 10, or the pressure drop in insert 44 is minimal. To limit the impact on pressure in heat exchanger 10, while still achieving adequate mixing and distribution of fluid 26, the shape, number and positioning of perforations 46 can be adjusted.

The size and positioning of perforations 46 can also influence the degree that fluid 26 is effectively distributed through heat exchanger 10. In one embodiment, one perforation 46 can be associated with a number of tubes 34 or 50. In some embodiments, one perforation 46-1 is associated with four to six tubes 34 and one perforation 46-2 is associated with four to six tubes 50. In another aspect, one perforation 46-1 can be assigned to every tube 34 and one perforation 46-2 can be assigned to every tube 50.

Insert 44 in return manifold 40 permits the collection of fluid 26, that after evaporation may contain a portion of vapor and liquid to be mixed prior to distribution to second pass 14. The resulting two-phase mixture can cause maldistribution in the evaporator, which is a common problem with heat exchangers that use parallel refrigerant paths, resulting in poor heat exchanger efficiency. In mini-channel or micro-channel heat exchangers the concern is even greater because the flow of refrigerant is divided into many small tubes, where every tube and mini-channel is to receive just a small and equal fraction of the total refrigerant flow.

Insert 44 provides a smaller chamber than return manifold 40 can provide, which increases turbulence of fluid 26 exiting the insert into chamber 48. Additionally, perforations 46 also aid in mixing and distributing fluid 26 into chamber 48. Turbulence in insert 44 is one factor that increases distribution and mixing of fluid 26 entering chamber 48. Insert 44 positioned in either the return manifold 40 or an inlet manifold in between successive passes can greatly diminish maldistribution.

After fluid 26 has been distributed through insert 44 and has passed transition line 16, fluid 26 enters second pass 14. Perforations 46-2 in insert 44 in second pass 14 enable fluid 26 to exit insert 44. Fluid 26 leaving insert 44 enters chamber 48 in second pass 14 of return manifold 40. Chamber 48 is an extension of return manifold 40.

After entering chamber 48, fluid 26 enters tubes 50 in second pass 14, which have an inlet end 52 and an outlet end 54. Tubes 50 are similar to tubes 34 excluding the distinction that tubes 34 are in first pass 12, and tubes 50 are in second pass 14.

Fluid 26 travels the length of tube 50 and exits outlet end 54 to enter outlet chamber 56, where the fluid can continue on through several additional passes (not shown), or exit heat exchanger 10.

Referring to FIG. 2, a sectional view of the heat exchanger of FIG. 1, taken along lines 2-2 is shown. As shown, insert 44 can be a separate tube that is in manifold 40 that is generally D-shape, i.e., where insert 44 has an arched, rear wall 58-2 and a flat, front wall 58-1, although any other shape that is easily manufactured could be used that would permit flow of fluid 26. Flat wall 58-1 has perforations 46-1 and 46-2 for collecting, receiving, mixing, and distributing fluid 26.

Insert 44 is shown in FIG. 2 by way of example as being a separate component to heat exchanger 10. However, it is also contemplated by the present disclosure for insert 44 to be integrally formed in return manifold 40. For example, insert 44 integrally formed with manifold 40 is described with reference to FIG. 3.

Figure 3:
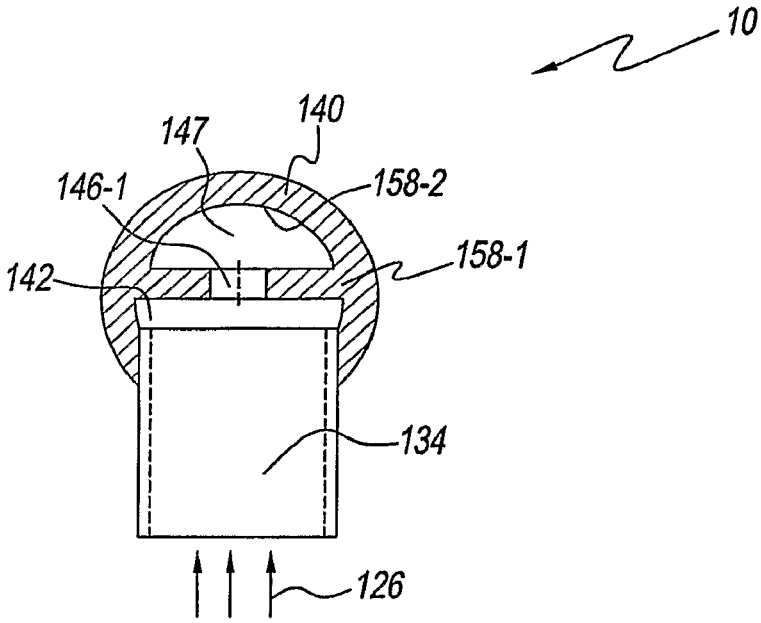
FIG. 3 is a sectional view of an alternative exemplary embodiment of the heat exchanger of FIG. 2.

In the embodiment illustrated in FIG. 3, outer, rear wall 158-2 of manifold 140 is combined with the outer wall of the manifold, while flat, front wall 158-1 is integrally formed with the outer wall.

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out the apparatus in present disclosure, but that the disclosed apparatus will include all embodiments falling within the scope of the disclosure.

What is claimed is:

1. A multi-pass heat exchanger comprising:

a return manifold having a partition, a front wall, and a rear wall, said partition separating said return manifold into a collection chamber and a distribution chamber, said front and rear walls defining a fluid channel, said front wall having a plurality of perforations on both sides of said partition placing said fluid channel in separate fluid communication with said collection chamber and said distribution chamber;

a first pass of tubes in fluid communication with said collection chamber; and a second pass of tubes in fluid communication with said distribution chamber;

an inlet manifold divided into an inlet chamber and an outlet chamber by a second partition, said inlet chamber being in fluid communication with said first pass of tubes, and said outlet chamber being in fluid communication with said second pass of tubes;

an internal distributor within said inlet chamber of said inlet manifold, said internal distributor having a series of orifices that distribute fluid into said inlet chamber of said inlet manifold;

wherein said plurality of perforations comprise only one perforation associated with each tube in said first pass of tubes and only one perforation associated with each tube in said second pass of tubes.

2. The heat exchanger of claim 1, wherein said rear wall is integral with said return manifold.

3. A multi-pass heat exchanger comprising:

an inlet manifold having a first partition defining an inlet chamber and an outlet chamber;

an internal distributor within said inlet chamber of said inlet manifold, said internal distributor having a series of orifices that distribute fluid into said inlet chamber of said inlet manifold;

a return manifold having a second partition defining a collection chamber and a distributing chamber;

a plurality of channels defining a first fluid flow path between said inlet chamber and said collection chamber and a second fluid flow path between said distributing chamber and said outlet chamber; and a distributing insert within said return manifold, said distributing insert having a first plurality of perforations on one side of said second partition in fluid communication with said collection chamber and a second plurality of perforations on another side of said second partition in fluid communication with said distributing chamber;

wherein each perforation of said first and second plurality of perforations is associated with more than one channel of said plurality of channels.

4. A multi-pass heat exchanger comprising:

a return manifold having a partition, a front wall, and a rear wall, said partition separating said return manifold into a collection chamber and a distribution chamber, said front and rear walls defining a fluid channel, said front wall having a plurality of perforations on both sides of said partition placing said fluid channel in separate fluid communication with said collection chamber and said distribution chamber;

a first pass of tubes in fluid communication with said collection chamber; and a second pass of tubes in fluid communication with said distribution chamber;

an inlet manifold divided into an inlet chamber and an outlet chamber by a second partition, said inlet chamber being in fluid communication with said first pass of tubes, and said outlet chamber being in fluid communication with said second pass of tubes;

an internal distributor within said inlet chamber of said inlet manifold, said internal distributor having a series of orifices that distribute fluid into said inlet chamber of said inlet manifold;

wherein said plurality of perforations comprise perforations associated with more than one tube in said first pass of tubes and perforations associated with more than one tube in said second pass of tubes.

5. A multi-pass heat exchanger comprising:

a return manifold having a partition, a front wall, and a rear wall, said partition separating said return manifold into a collection chamber and a distribution chamber, said front and rear walls defining a fluid channel, said front wall having a plurality of perforations on both sides of said partition placing said fluid channel in separate fluid communication with said collection chamber and said distribution chamber;

a first pass of tubes in fluid communication with said collection chamber; and a second pass of tubes in fluid communication with said distribution chamber;

an inlet manifold divided into an inlet chamber and an outlet chamber by a second partition, said inlet chamber being in fluid communication with said first pass of tubes, and said outlet chamber being in fluid communication with said second pass of tubes;

an internal distributor within said inlet chamber of said inlet manifold, said internal distributor having a series of orifices that distribute fluid into said inlet chamber of said inlet manifold;

wherein said front and rear walls define a distributing insert, said distributing insert being in said return manifold.

6. A multi-pass heat exchanger comprising:

an inlet manifold having a first partition defining an inlet chamber and an outlet chamber:

an internal distributor within said inlet chamber of said inlet manifold, said internal distributor having a series of orifices that distribute fluid into said inlet chamber of said inlet manifold;

a return manifold having a second partition defining a collection chamber and a distributing chamber;

a plurality of channels defining a first fluid flow path between said inlet chamber and said collection chamber and a second fluid flow path between said distributing chamber and said outlet chamber; and a distributing insert within said return manifold, said distributing insert having a first plurality of perforations on one side of said second partition in fluid communication with said collection chamber and a second plurality of perforations on another side of said second partition in fluid communication with said distributing chamber;

wherein each perforation of said first and second plurality of perforations is associated with a single channel of said plurality of channels.

7. The heat exchanger of claim 6, wherein said distributing insert has a first wall that is arched and a second wall that is flat.

8. The heat exchanger of claim 7, wherein said first and second plurality of perforations are disposed on said flat wall.

9. The heat exchanger of claim 3, wherein said plurality of perforations comprises a plurality of collecting perforations and a plurality of distributing perforations, said plurality of collecting perforations placing said collection chamber and said fluid channel in fluid communication with one another, and said plurality of distributing perforations placing said distributing chamber and said fluid channel in fluid communication with one another.

10. A multi-pass heat exchanger comprising:

an inlet manifold having a first partition defining an inlet chamber and an outlet chamber;

an internal distributor within said inlet chamber of said inlet manifold, said internal distributor having a series of orifices that distribute fluid into said inlet chamber of said inlet manifold;

a return manifold having a second partition defining a collection chamber and a distributing chamber;

a plurality of channels defining a first fluid flow path between said inlet chamber and said collection chamber and a second fluid flow path between said distributing chamber and said outlet chamber; and a distributing insert within said return manifold, said distributing insert having a first plurality of perforations on one side of said second partition in fluid communication with said collection chamber and a second plurality of perforations on another side of said second partition in fluid communication with said distributing chamber;

wherein said plurality of first and second perforations increase in size with respect a fluid flow path.

11. A multi-pass heat exchanger comprising:

an inlet manifold having a first partition defining an inlet chamber and an outlet chamber:

an internal distributor within said inlet chamber of said inlet manifold, said internal distributor having a series of orifices that distribute fluid into said inlet chamber of said inlet manifold;

a return manifold having a second partition defining a collection chamber and a distributing chamber;

a plurality of channels defining a first fluid flow path between said inlet chamber and said collection chamber and a second fluid flow path between said distributing chamber and said outlet chamber; and a distributing insert within said return manifold, said distributing insert having a first plurality of perforations on one side of said second partition in fluid communication with said collection chamber and a second plurality of perforations on another side of said second partition in fluid communication with said distributing chamber;

wherein said distributing insert is integral with said return manifold.

* * * * *